US006824503B2

(12) United States Patent
Wang et al.

(10) Patent No.: US 6,824,503 B2
(45) Date of Patent: Nov. 30, 2004

(54) CRANK AND BASE OF A TREADING EXERCISE APPARATUS

(76) Inventors: Leao Wang, No. 1, Lane 233, Sec. 2, Charng Long rd., Taiping (TW), 411; Peter Wu, No. 1, Lane 233, Sec. 2, Charng Long rd., Taiping (TW), 411

( * ) Notice: Subject to any disclaimer, the term of this patent is extended or adjusted under 35 U.S.C. 154(b) by 56 days.

(21) Appl. No.: 10/386,540

(22) Filed: Mar. 13, 2003

(65) Prior Publication Data

US 2004/0180759 A1 Sep. 16, 2004

(51) Int. Cl.[7] ..... A63B 23/04
(52) U.S. Cl. ..... 482/60
(58) Field of Search ..... 482/35–37, 58–60, 482/57; D21/663, 670

(56) References Cited

U.S. PATENT DOCUMENTS 950,100 A * 2/1910 Gough ..... 482/37
2,484,153 A * 10/1949 Chaudoir, sr. ..... 482/60
4,169,591 A * 10/1979 Douglas ..... 482/58
4,973,046 A * 11/1990 Maxwell ..... 482/60
6,106,440 A * 8/2000 Olbrish, Jr. ..... 482/57

* cited by examiner

*Primary Examiner*—Stephen R. Crow
(74) *Attorney, Agent, or Firm*—Troxell Law Office PLLC; Kuo-Hsiung Chiu

(57) ABSTRACT

The invention relates to a treading exercise apparatus that includes a crank and a base. The crank is constructed as a first shaft in the middle thereof on which a bearing, a bushing and a resistance flywheel are received so that the crank rotates on a middle post of the base. Meanwhile, both sides of the first shaft are constructed as a correspondingly symmetric U-shaped treadle rod relative to the shaft which a treadle pad is rotatably received for treading movement in alternating succession. The outer side of each of the treadle rods is constructed as a second shaft. The second shafts and the first shaft are coaxially disposed along a horizontal axle line L. Moreover, the second shafts extend through side posts of the base respectively and are rotatably mounted thereon. Since the unbalanced force created by the treading movement on the crank is effectively supported, a stable treading movement can be achieved. Meanwhile, the related components can be well protected from damage, thereby elongating the service life thereof.

1 Claim, 1 Drawing Sheet

CRANK AND BASE OF A TREADING EXERCISE APPARATUS

BACKGROUND OF THE INVENTION

1. Field of the Invention

The invention relates to a new and improved crank and a base of a treading exercise apparatus, and more particularly, to a single crank having two supporting shafts that are rotatably and coaxially positioned on corresponding posts of a base. Since the unbalanced force created by the treading movement on the crank is effectively supported, a stable treading movement can be achieved. Meanwhile, the related components can be well protected from damage, thereby elongating the service life thereof.

2. Description of the Related Art

The so-called treading exercise apparatuses include all in-place exercise means for treading movement. This apparatus is well known so that no further descriptions of its basic configuration and operational principles are given hereinafter. However, the local components of the crank related to the invention are described as follows:

Referring to FIG. 2, the assembly of the crank 10 and the base 11 of a conventional treading exercise apparatus is shown. The crank is constructed as a horizontal shaft 12 in the middle thereof on which a bearing 13, a bushing 14 and a resistance flywheel 15 (or toothed plate) are received so that the crank 10 rotates on a middle post 16 of the base 11. Meanwhile, both sides of the first shaft 12 are constructed as a correspondingly symmetric L-shaped treadle rod 25 relative to the shaft 21 on which a treadle pad 26 is rotatably received for treading movement in alternating succession.

The above-mentioned configuration of the crank 10 and the base 11 has been used for over decades and doesn't have tremendous change. However, a rubbing sound is apparently created from the position of the crank 10 after a long period of usage. For more serious situation, the crank 10 operates with difficulties. Even when the bearing 13 and the bushing 14 of the crank 10 are replaced by new ones or oiled, people can be free of mechanical noise only for a short period. Thereafter, the noise arises again, thereby giving much trouble to the user.

In fact, the above-mentioned problem arises due to the unbalanced application of force on both sides of the crank when the operator uses both feet to perform treading movement (that is, one foot exerts force while the other is in relaxed state. Of course, the crank is operated by this principle.). If the load of the crank 10 is supported only by the horizontal shaft 12 and the middle post 16 of the base 11, the bearing 13 and the bushing 14 must be considerably loaded.

Thus, it's inevitable that the bearing 13 and the bushing 14 are seriously damaged after a long period of usage. For the serious situation, noise arises; for the more serious situation, the bearing 13 and the axle hole of the middle post 16 are worn off. At this time, it's also useless to replace with an excellent bearing 13.

SUMMARY OF THE INVENTION

An object of the invention is to eliminate the above-mentioned drawbacks and to provide a crank and a base of a treading exercise apparatus in which a single crank is specially designed to have two supporting shafts that are rotatably and coaxially positioned on corresponding posts of a base. Since the unbalanced force created by the treading movement on the crank is effectively supported, a stable treading movement can be achieved. Meanwhile, the related components can be well protected from damage, thereby elongating the service life thereof.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
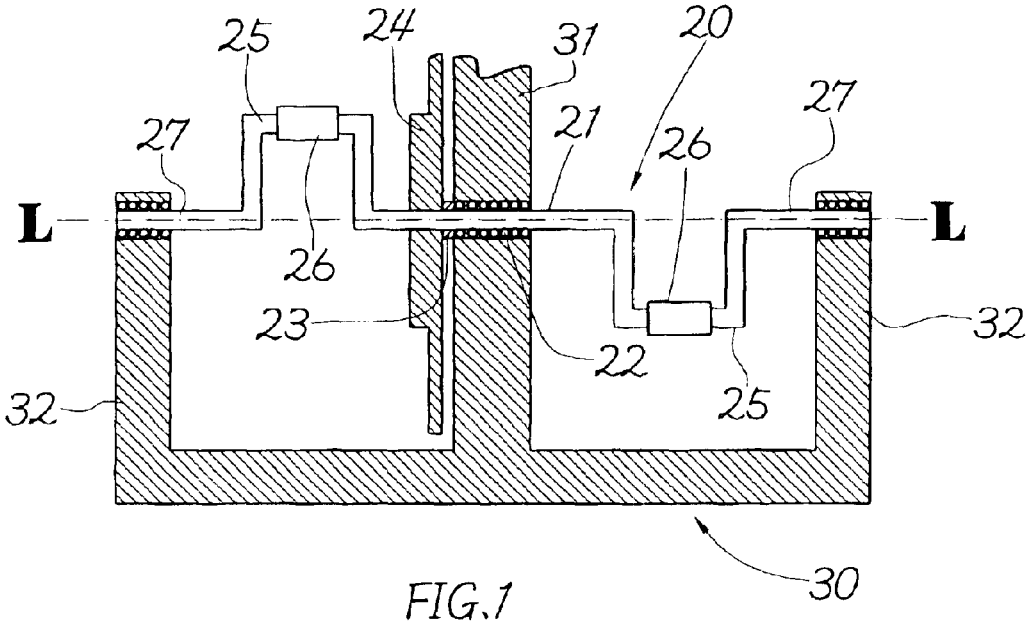
FIG. 1 is a schematic drawing of a preferred embodiment of the invention.
Figure 2:
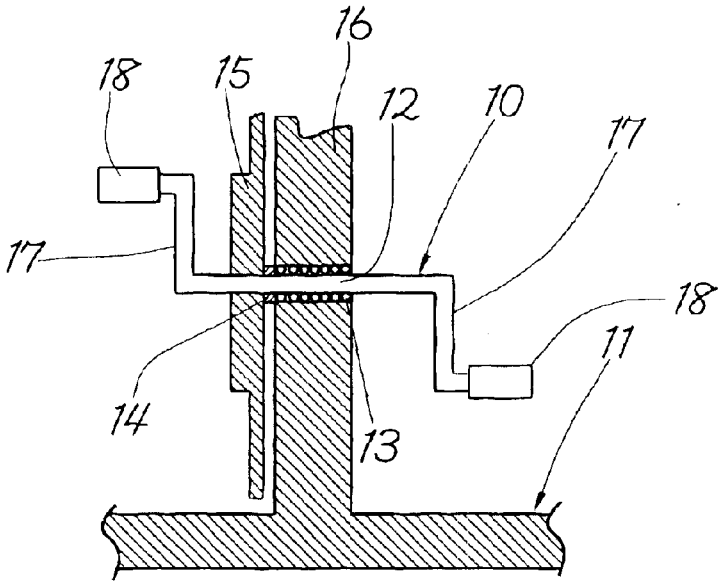
FIG.2 PRIOR ART
FIG. 2 is a schematic drawing of the assembly of the crank and the base of a conventional treading exercise apparatus.

First of all, referring to FIG. 1, a preferred embodiment of the invention is shown. The invention includes a crank 20 and a base 30. The crank 20 is constructed as a first shaft 21 in the middle thereof on which a bearing 22, a bushing 23 and a resistance flywheel 24 are received so that the crank 20 rotates on a middle post 31 of the base 30. Meanwhile, both sides of the first shaft 21 are constructed as a correspondingly symmetric U-shaped treadle rod 25 relative to the shaft 21 on which a treadle pad 26 is rotatably received for treading movement in alternating succession. The outer side of each of the treadle rods 25 is constructed as a second shaft 27. The second shafts 27 and the first shaft 21 are coaxially disposed along a horizontal axle line L. Moreover, the second shafts 27 extend through side posts 32 of the base 30 respectively and are rotatably mounted thereon.

Based upon the above-mentioned configuration, when the force is exerted on the crank 20, the force will be evenly transmitted to the middle post 31 and both side posts 32 through the first shaft 21 and the second shafts 27. Since the unbalanced force created by the treading movement on the crank 20 is effectively supported, a stable treading movement can be achieved.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claim.

What is claimed is:

1. A treading exercise apparatus comprising:

a) a base having a middle post and two side posts, the side posts located on opposite sides of the middle post; and b) a crank having:

i) a first shaft rotatably positioned through the middle post a flywheel located on the first shaft;

ii) two second shafts, one of the two second shafts rotatably positioned in each of the two side posts, wherein the two second shafts and the first shaft are axially aligned; and iii) two U-shaped treadle rods, one of the two U-shaped treadle rods located between the first shaft and each of the two second shafts, wherein the first shaft, the two second shafts, and the two U-shaped treadle rods are integrally formed.

* * * * *